US006644286B2

(12) United States Patent
Kapolnek et al.

(10) Patent No.: US 6,644,286 B2
(45) Date of Patent: Nov. 11, 2003

(54) METHOD AND SYSTEM FOR CONTROLLING FUEL DELIVERY DURING TRANSIENT ENGINE CONDITIONS

(75) Inventors: Chris Dominic Kapolnek, Dearborn, MI (US); Jeffrey Allen Doering, Canton, MI (US); Xiaoying Zhang, Dearborn Hts., MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 214 days.

(21) Appl. No.: 09/683,033

(22) Filed: Nov. 9, 2001

(65) Prior Publication Data

US 2003/0089342 A1 May 15, 2003

(51) Int. Cl.[7] ..... F02M 51/00
(52) U.S. Cl. ..... 123/492; 123/493

(58) Field of Search ..... 123/492, 493, 123/478, 472, 445

(56) References Cited

U.S. PATENT DOCUMENTS

| | | | | |
|---|---|---|---|---|
| 4,463,731 | A | 8/1984 | Matsuoka | |
| 5,746,183 | A | 5/1998 | Parke et al. | |
| 6,067,965 | A | 5/2000 | Trumpy et al. | |
| 6,257,206 | B1 * | 7/2001 | Doering et al. | 123/480 |

* cited by examiner

*Primary Examiner*—Bibhu Mohanty

(57) ABSTRACT

A method and system for controlling fuel mass during transient engine conditions is based on an open loop transient fuel compensation algorithm so as to provide transient fuel compensations that address drivability requirements associated with the acceleration mode and deceleration mode of engine operation as well as the ease of the calibration during engine cranking mode.

22 Claims, 2 Drawing Sheets

METHOD AND SYSTEM FOR CONTROLLING FUEL DELIVERY DURING TRANSIENT ENGINE CONDITIONS

BACKGROUND OF INVENTION

1. Field of the Invention

This invention relates to methods and systems for controlling an amount of fuel delivered to an individual engine cylinder during transient engine operating conditions.

2. Background Information

Under a steady-state operating condition of an internal combustion engine, the mass of the air charge for each cylinder event is constant. The fuel transport mechanisms in the fuel intake have reached near equilibrium conditions, allowing a constant mass of injected fuel for each combustion event in each cylinder. However, when the engine operating condition is not steady-state, such as in an acceleration mode or deceleration mode, the mass of injected fuel required to achieve the desired air/fuel ratio in each cylinder is not constant as a result of transients in the mass of air charge being delivered to the cylinders.

Various attempts have been made to improve control of air/fuel ratios during transient engine conditions. For example, U.S. Pat. No. 5,746,183 describes control of fuel mass based on a fuel puddle model representative of a fuel puddle that theoretically is present in the intake manifold. The fuel puddle model uses a first order X and tau coupled inverse compensator model of the fuel puddle to control transient fuel compensation. For example, an initial estimate of desired fuel mass of the puddle per cylinder embodies a fuel/air function (f_a_ratio[n]) that represents a desired in-cylinder fuel-air ratio for that cylinder's bank and comprises a closed loop input to the inverse compensator mathematics from another section of the engine control routine.

The dynamic response of the inverse compensator model is limited by the model and mathematical constraints imposed by the model (e.g. the coupling between X and tau as well as use of single X and tau values for both acceleration and deceleration modes) and as a result may encounter difficulty in responding to different drivability requirements associated with acceleration and deceleration modes of engine operation. The model-based control system is designed to provide mandatory fuel compensation during the engine crank mode. The mandatory fuel compensation during engine crank mode has resulted in increased calibration efforts to make this system responsive, primarily due to the interaction between transient compensation and crank fuel calculation.

SUMMARY OF INVENTION

The present invention provides a method and system for controlling fuel mass during transient engine conditions that is based on a transient fuel compensation algorithm that provides transient fuel compensations that address drivability requirements associated with the acceleration mode and deceleration mode of engine operation as well as the cranking mode of engine operation.

In accordance with an illustrative embodiment of the invention, a method and system for determining fuel mass to be delivered to each cylinder of an internal combustion engine during transient engine operation involve determining a desired in-cylinder fuel mass for combustion based on a plurality of engine parameters, determining whether a current mode of engine operation is an acceleration mode or a deceleration mode, and determining a transient fuel mass compensation factor (mf_tfc[inj]) in response to the determined current acceleration or deceleration mode of engine operation. The transient fuel mass compensation factor and a base desired in-cylinder fuel mass (calculated from fuel air ratio) are combined to provide a desired injected fuel mass for the next combustion event for each cylinder.

In a particular embodiment of the invention, the desired in-cylinder fuel mass for combustion is determined from engine parameters representing air charge, feedforward air-fuel demand, and air/fuel stoichiometric ratio.

In another particular embodiment of the invention, the determination of the current mode of engine operation is made by comparing the desired in-cylinder fuel mass for combustion and a filtered desired in-cylinder fuel mass obtained using the prior injection history of each cylinder and a time constant determined in response to the determined current acceleration or deceleration mode of engine operation.

In still another particular embodiment of the invention, the determination of a transient fuel mass compensation factor is made by obtaining a difference between the desired in-cylinder fuel mass for combustion and the filtered desired in-cylinder fuel mass and multiplying the difference by a value of a gain multiplier determined in response to the determined current acceleration or deceleration mode of engine operation.

In still another particular embodiment of the invention, the method and system of the invention optionally can force the transient fuel compensation factor to zero during an engine crank mode such that no fuel transient compensation is conducted during the engine crank mode.

The present invention is advantageous for determining transient fuel compensations for each cylinder independently for the acceleration mode or deceleration mode of engine operation to improve drivability and avoids transient fuel compensation during the engine crank mode, reducing calibration requirements for the method and system.

The above advantages of the present invention will become more readily apparent from the following description taken with the following drawings.

DETAILED DESCRIPTION

Figure 1:
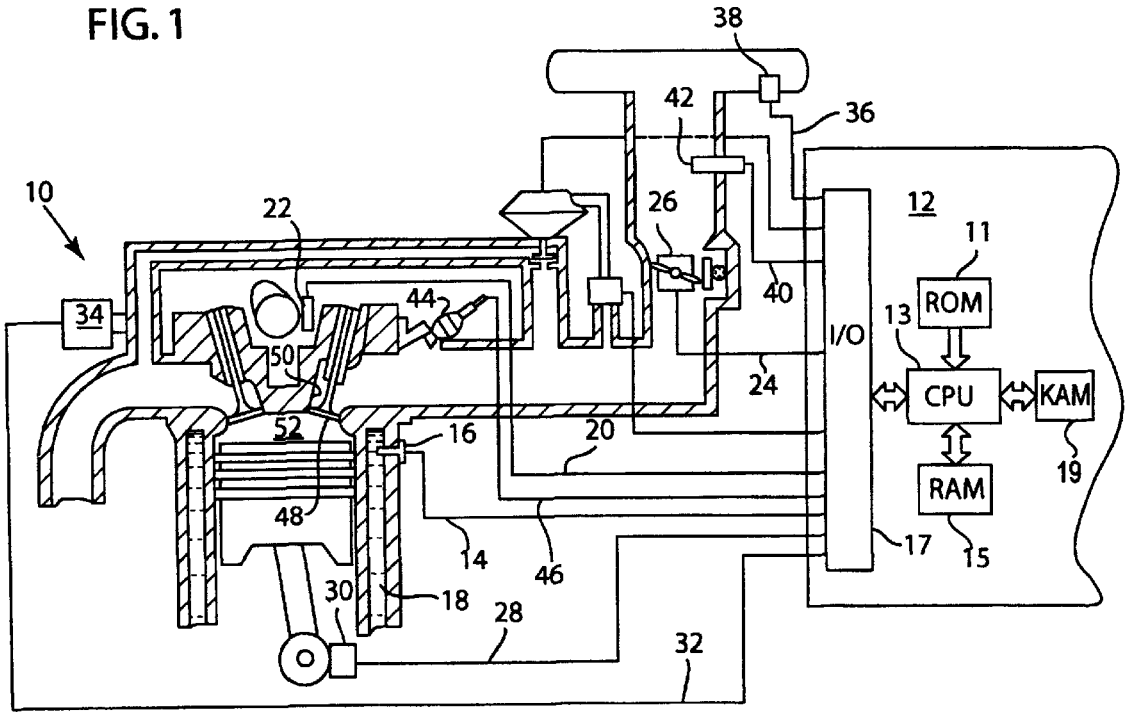
FIG. 1 is a schematic view of an internal combustion engine and an electronic engine control unit for practicing an embodiment of the invention.

Referring to FIG. 1, the present invention can be practiced in connection with an internal combustion engine 10 that includes a plurality of combustion chambers or cylinders 52, one of which is shown in FIG. 1. The engine 10 is controlled by an electronic control unit (ECU) 12 having a read only memory (ROM) 11, a central processing unit (CPU) 13, a random access memory (RAM) 15, and a keep alive (KAM) memory 19, which retains information when the engine ignition key is turned-off for use when the engine is restarted. The ECU 12 can be embodied by an electronically programmable microprocessor, a microcontroller, an application-specific integrated circuit, or a like device to provide a predetermined control logic.

The ECU 12 receives a plurality of signals from the engine 10 via an input/output port 17. Such signals include, but are not limited to, an engine coolant temperature (ECT) signal 14 from an engine coolant temperature sensor 16 which is exposed to engine coolant circulating through the coolant passage 18, a cylinder identification number (CID) signal from a CID sensor 22, a throttle position signal 24 generated by a throttle position sensor 26, a signal 28 which may be a profile ignition pick-up (PIP) signal generated by a crank position sensor 30, a heated exhaust gas oxygen (HEGO) signal 32 from HEGO sensor 34, an air intake temperature signal 36 from an air temperature sensor 38, and an air flow signal 40 for an air flow sensor 42.

The ECU 12 processes these signals received from the engine sensors and generates corresponding signals, such as a fuel injector pulse waveform signal that is transmitted to each fuel injector 44 of each cylinder 52 on a signal line 46 to control the amount of fuel delivered by each fuel injector 44. ECU 12 also generates an ignition signal (not shown) for receipt by a spark plug (not shown) associated with cylinder 52 in known manner to initiate combustion of the air and fuel mixture in cylinder 52. An intake valve 48 associated with each combustion chamber or cylinder 52 operates to open and close intake port 50 to control the entry of an air/fuel mixture into each combustion chamber or cylinder 52. Although the embodiment of the invention is illustrated in connection with what is typically referred to as a port injected engine, the present invention is not so limited and also applies to a direct injection engine in which the fuel is injected directly into the combustion chamber of the engine 10.

The air flow signal 40 (from which an air charge estimate is computed) from air flow sensor 42 is updated every profile ignition pickup (PIP) event for each cylinder 52, which is used to trigger all fuel calculations. The average desired fuel-air ratio is used in calculation of the desired in-cylinder fuel mass for combustion in each cylinder 52. This desired in-cylinder fuel mass for combustion is then used as the basis for all fuel calculations for each cylinder including initial main pulse scheduling, and injector updates. Since the initial main fuel for each cylinder must be scheduled in advance of delivery, the air charge estimate can change radically during transient engine operating conditions, such as acceleration mode and deceleration mode of engine operation.

The present invention provides a method and system for controlling fuel mass during such transient engine operating conditions to each cylinder of multi-cylinder internal combustion engine, the method and control system being based on a transient fuel compensation algorithm that controls transient fuel compensations independently for the acceleration mode and the deceleration mode of engine operation and in response to a plurality of engine parameters.

Figure 2:
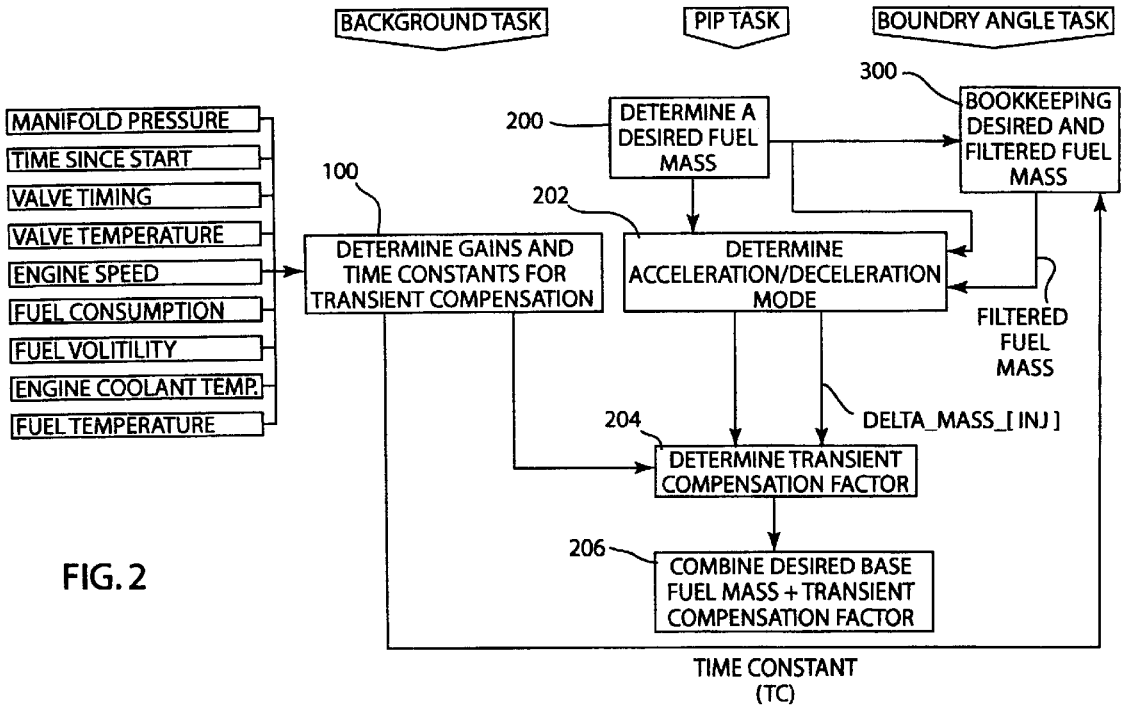
FIG. 2 is flow diagram illustrating the general sequence of steps associated with the operation of an illustrative embodiment of the invention.

Referring to FIG. 2, there is shown a flow diagram illustrating a routine performed by control logic of the ECU 12. The parallel steps shown in FIG. 2 can be implemented using interrupt-driven programming strategies, object-oriented programming, or the like. The steps shown in FIG. 2 typically comprise a portion of a larger routine which performs other engine control functions.

Pursuant to an illustrative embodiment of the invention, the routine performs a so-called PIP task, Boundary Angle task, and Background task. The PIP task is an event based foreground (high priority) task which occurs every two (2) revolutions for each cylinder. The air charge value is updated during that event. The Boundary Angle task is conducted at the boundary angle interrupt for each cylinder, which takes place at the crank angle position where no more fuel can be ingested for the current combustion cycle. For purposes of illustration and not limitation, the boundary angle interrupt occurs when the intake valve 48 is closing to two-thirds of its full open position and occurs every two revolutions for each cylinder.

The Background task of step 100 is conducted periodically on a fixed time basis, as opposed to an event basis, such as for example every 50 milliseconds to generate a value of a time constant TC and a value of a gain pursuant to the invention. In particular, the Background task calculates a value of a time constant TC and a value of a gain for the acceleration mode and a value for a time constant TC and a value of a gain for the deceleration mode of engine operation using three dimensional tables and/or two dimensional functions collectively designated $F_x$ and obtained by direct measurement and/or inference. One set of such tables and/or functions is provided for the acceleration mode and another set is provided for the deceleration mode. The Background task calculations thereby provide two independent sets of TC and gain values, one set for the acceleration mode and the other set for the deceleration mode independently of one another.

The gain and TC values are calculated based on engine operating conditions that include manifold pressure, coolant temperature, speed, time since start, intake valve temperature, fuel content (% methanol), fuel volatility, fuel temperature, injector cutoff request, variable valve timing control request, etc.

For purposes of illustration and not limitation, the following can be calculated:

acceleration gain and TC:

tfc_gn_a=F1(coolant temperature, time since start)+
F2(manifold pressure, engine speed)+
F3(fuel composition)+F4(valve timing)+
F5(fuel volatility)

tfc_tc_a=F6(coolant temperature, time since start)+
F7(manifold pressure, engine speed)+
F8(fuel composition)+F9(valve timing)+
F10(fuel volatility)

deceleration gain and TC:

tfc_gn_d=F11(coolant temperature, time since start)+
F12(manifold pressure, engine speed)+
F13(fuel composition)+F14(valve timing)+
F15(fuel volatility)

tfc_tc_d=F16(coolant temperature, time since start)+
F17(manifold pressure, engine speed)+
F18(fuel composition)+F19(valve timing)+
F20(fuel volatility)

In the Background task, the filtered in-cylinder fuel mass, mf_des [inj], can be forced in an embodiment of the invention to the value of instantaneous desired in-cylinder fuel mass for combustion (tfc_mf_des) throughout the crank mode, reflecting that the transient fuel compensation has been disabled for the duration. Also in the same task, the filtered in-cylinder fuel mass, mf_des[inj], can be compensated for an IMRC (intake manifold runner control) transition in a manner described in U.S. Pat. No. 6,257,206, the teachings of which are incorporated herein by reference.

The logic control for transient fuel compensation begins with step 200 wherein an instantaneous desired in-cylinder fuel mass for combustion (tfc_mf_des) is calculated for each combustion event:

(1) tfc_mf_des=cyl_air_chg_/(spk_lambse*ful_stoic_af)—pcomp_lbm where cyl_air_chg_ is the current estimate of inducted air mass per cylinder determined from air flow signal 40, spk_lambse is the average desired fuel-air ratio determined by feedforward control strategy (e.g. open loop fuel control), ful_stoic_af is the stoichiometric air-fuel ratio, and pcomp_lbm is the estimated fuel mass that the cylinder receives from a conventional purge system (not shown).

The desired in-cylinder fuel mass is neither cylinder bank specific nor cylinder specific, meaning that the same value thereof is used for calculating a particular transient fuel compensation for each cylinder. Although the invention is not so limited, for the particular application described, the desired in-cylinder fuel mass for combustion (tfc_mf_des) is determined without the influence of closed loop limit cycles. For example, equation (1) uses the listed plurality of engine parameters, all of which are available from open loop control algorithm.

The logic control flows to step 202 where there is a determination of whether the current transient mode of engine operation is an acceleration mode or a deceleration mode. This determination is made for each cylinder by determining the difference between the instantaneous desired in-cylinder fuel mass for combustion (tfc_mf_des) and a filtered version of that fuel mass for each fuel injector as follows:

(2) delta_mass_[inj]=tfc_mf_des-mf_des[inj]

where mf_des[inj] is the filtered desired in-cylinder fuel mass for each cylinder determined as described below by equation (3).

If the delta_mass[inj] value for a particular fuel injector is greater than or equal to 0, then an acceleration mode of engine operation is determined, and a flag, tfc_acc_flg[inj], is set in control logic indicating a determined current acceleration mode. Otherwise, a deceleration mode of engine operation is determined, and flag, tfc_acc_flg[inj], is cleared in control logic, indicating a determined current deceleration mode.

The filtered desired in-cylinder fuel mass for each fuel injector, mf_des[inj], is determined by Boundary Angle task using equation (3) for each cylinder that has just crossed its boundary angle as follows:

(3) $mf_des[inj]=mf_des^{k-1}[inj]*TC/(1+TC)+tfc_mf_des/(1+TC)$ where $mf_des^{k-1}[inj]$ is the last pass value of the same parameter and TC (or tc) is a time constant value determined in the Background task and pursuant to the invention will be either a value, tfc_tc_a, for a determined current acceleration mode or a value, tfc_tc_d, for a determined current deceleration mode of engine operation depending on the status flag tfc_acc_flg[inj] set in step 102. That is, if tfc_acc_flg[inj]=accel, then the TC value, tfc_tc_a, is determined. If tfc_acc_flg[inj]=decel, then the TC value, tfc_tc_d_, is determined.

When a cylinder is cut out of operation, the tfc_mf_des will be substituted by zero in equation (3) to reflect the deactivation of the fuel injector associated with that cut-out cylinder.

The values of mf_des_[inj] are updated in bookkeeping step 300 for use in the next Boundary Angle task.

The logic control flows to step 204 where a transient in-cylinder fuel mass compensation (mf_tfc_[inj]) is calculated for each fuel injector as follows:

(4) mf_tfc_[inj]=delta_mass_[inj]*gain where the gain value is determined in the Background task and pursuant to the invention will be either a value, tfc_gn_a, for a determined current acceleration mode or a value, tfc_gn_d, for a determined current deceleration mode of engine operation as determined by the status flag tfc_acc_flg[inj] set in step 202. That is, if tfc_acc_flg[inj]=accel, then the gain value, tfc_gn_a, is determined. If tfc_acc_flg[inj]=decel, then the gain value, tfc_gn_d_, is determined.

The transient in-cylinder fuel mass compensation (mf_tfc_[inj]) can comprise a transient adder for a determined current acceleration mode of engine operation or a transient subtractor for a determined current deceleration mode of engine operation. The transient in-cylinder fuel mass is determined independently for the acceleration mode and for the deceleration mode pursuant to the invention as is apparent from the above description.

In step 206, the transient in-cylinder fuel mass compensation (mf_tfc_[inj]) is combined with a base desired fuel mass (calculated from fuel air ratio) to provide an injected fuel mass for each cylinder for the next combustion event. The base desired in-cylinder fuel mass is calculated as described in U.S. Pat. No. 5,746,183, the teachings of which are incorporated herein by reference, and, in particular, is calculated as set forth in equation (4) of the patent during the PIP task.

During a crank mode of operation, the logic control can force the value of delta_mass to zero (i.e. mf_des[inj]=tfc_mf_des) to ensure that there is no transient fuel compensation during the crank mode of engine operation. That is, transient fuel compensation can be decoupled from the crank mode of engine operation in practice of an embodiment of the invention. The invention is not so limited as transient fuel compensation optionally can be conducted during the crank mode.

The above steps 202, 204 and 206 are performed for all of the fuel injectors 44 so as to control fuel mass delivered to all cylinders under transient engine conditions.

While the invention has been described in terms of specific embodiments thereof, it is not intended to be limited thereto but rather only as set forth in the appended claims.

What is claimed is:

1. In a method for determining fuel mass to be delivered to an individual cylinder of an internal combustion engine during transient engine operation, the steps comprising:

determining a desired in-cylinder fuel mass for combustion based on a plurality of engine parameters, determining whether a current mode of engine operation is an acceleration mode or a deceleration mode, and determining a transient fuel mass compensation factor for the determined current mode of engine operation.

2. The method of claim 1 including the further step of combining said transient fuel mass compensation factor and a base desired fuel mass to provide a desired injected fuel mass for the next combustion event of said cylinder.

3. The method of claim 1 wherein said determining of the current mode of engine operation is made by comparing said desired in-cylinder fuel mass for combustion and a filtered desired in-cylinder fuel mass obtained using a prior injection history of the cylinder and a value of a time constant determined in response to the determined current mode of engine operation.

4. The method of claim 3 wherein said determining of a transient fuel mass compensation factor is made by obtaining a difference between said desired in-cylinder fuel mass and said filtered desired in-cylinder fuel mass and multiplying said difference by a value of a gain determined in response to the determined current mode of engine operation.

5. The method of claim 1 wherein said transient fuel compensation factor is forced to zero during an engine crank mode.

6. A method for determining fuel mass to be delivered to an individual cylinder of an internal combustion engine during transient engine operation, comprising:

determining a desired in-cylinder fuel mass for combustion based on a plurality of engine parameters, determining a value of a time constant and a value of a gain for an acceleration mode of engine operation, determining a value of a time constant and a value of a gain for a deceleration mode of engine operation, determining whether a current mode of engine operation is an acceleration mode or a deceleration mode, determining a filtered desired in-cylinder fuel mass based on said desired in-cylinder fuel mass, a prior injection history of the cylinder, and a value of the time constant determined in response to the determined current mode of engine operation, and determining a transient fuel compensation factor by obtaining a difference between said desired in-cylinder fuel mass and said filtered desired in-cylinder fuel mass and multiplying said difference by a value of the gain determined for the determined current mode of engine operation.

7. The method of claim 6 including the further step of combining said transient fuel compensation factor and a base desired fuel mass to provide a desired injected fuel mass for the cylinder.

8. The method of claim 6 wherein said determining of said desired in-cylinder fuel mass for combustion is based on said plurality of parameters that include an average desired air/fuel ratio.

9. The method of claim 6 wherein said determining of said current mode of engine operation is based on a difference between said desired in-cylinder fuel mass and said filtered desired in-cylinder fuel mass.

10. The method of claim 6 further including setting said desired in-cylinder fuel mass and filtered desired in-cylinder fuel mass equal to one another during an engine crank mode of operation such that said transient fuel compensation factor is forced to zero during said engine crank mode.

11. The method of claim 6 including updating the prior injection history of the cylinder to include said transient desired in-cylinder fuel mass for bookkeeping.

12. A system for determining fuel mass to be delivered to an individual cylinder of an internal combustion engine during transient engine operation, comprising:

a plurality of sensors for sensing a plurality of engine parameters, and control logic medium operative to determine a desired in-cylinder fuel mass for combustion based on a plurality of engine parameters, a current mode of engine operation as an acceleration mode or a deceleration mode, and a transient fuel mass compensation factor for the determined current acceleration mode or deceleration mode of engine operation.

13. The system of claim 12 wherein the control logic medium determines a desired injected fuel mass by combining said transient fuel mass compensation factor and a base desired fuel mass.

14. The system of claim 12 wherein the control logic medium is operative to determine the current mode of engine operation by comparing said desired in-cylinder fuel mass and a filtered desired in-cylinder fuel mass obtained using the prior injection history of the cylinder, and a value of a time constant determined in response to the determined current mode of engine operation.

15. The system of claim 14 wherein the control logic medium is operative to determine the transient fuel mass compensation factor by a) obtaining a difference between said desired in-cylinder fuel mass and said filtered desired in-cylinder fuel mass and b) multiplying said difference by a value of a gain determined in response to the determined current mode of engine operation.

16. The system of claim 12 wherein the control system is operative to force said transient fuel compensation factor to zero during an engine crank mode.

17. A system for determining fuel mass to be delivered to an individual cylinder of an internal combustion engine during transient engine operation, comprising:

a plurality of sensors for sensing a plurality of engine parameters, and control logic medium operative to determine a desired in-cylinder fuel mass for combustion based on a plurality of engine parameters, a value of a time constant and a value of a gain for an acceleration mode of engine operation, a value of a time constant and a value of a gain for a deceleration mode of engine operation, whether a current mode of engine operation is an acceleration mode or a deceleration mode, a filtered desired in-cylinder fuel mass based on said desired in-cylinder fuel mass, a prior injection history of the cylinder, and a value of the time constant determined in response to the determined current mode of engine operation, and a transient fuel mass compensation factor by obtaining a difference between said desired in-cylinder fuel mass and said filtered desired in-cylinder fuel mass and multiplying said difference by a value of the gain multiplier determined in response to the determined current mode of engine operation.

18. The system of claim 17 wherein the control logic medium is operative to determine a desired injected fuel mass by combining said transient fuel mass compensation factor and a base desired fuel mass.

19. The system of claim 17 wherein the control logic medium is operative to determine said desired in-cylinder fuel mass for combustion based on said plurality of parameters that include an average desired air/fuel ratio.

20. The system of claim 17 wherein the control logic medium is operative to determine said current mode of engine operation based on a difference between said desired in-cylinder fuel mass and said filtered desired in-cylinder fuel mass.

21. The system of claim 17 where the control logic medium is further operative to set said desired in-cylinder fuel mass and said transient desired in-cylinder fuel mass equal to one another during an engine crank mode of operation such that said transient fuel compensation factor is forced to zero during said engine crank mode.

22. The system of claim 17 wherein the control logic medium is further operative to update the prior injection history of said cylinder to include said transient desired in-cylinder fuel mass for bookkeeping.

* * * * *